US005238396A

United States Patent [19]

Yap

[11] Patent Number: 5,238,396

[45] Date of Patent: Aug. 24, 1993

[54] FUEL-BURNER METHOD AND APPARATUS

[75] Inventor: Loo T. Yap, Princeton, N.J.

[73] Assignee: The BOC Group, Inc., New Providence, N.J.

[21] Appl. No.: 900,400

[22] Filed: Jun. 18, 1992

[51] Int. Cl.[5] ..... F23M 3/04

[52] U.S. Cl. ..... 431/10; 431/351; 431/354

[58] Field of Search ..... 431/10, 351, 354, 187, 431/188

[56] References Cited

U.S. PATENT DOCUMENTS

| | | | |
|---|---|---|---|
| 4,017,253 | 4/1977 | Wielang et al. | 431/10 |
| 4,541,796 | 9/1985 | Anderson | 431/10 |
| 5,104,310 | 4/1992 | Saltin | 431/10 |
| 5,145,361 | 9/1992 | Kurzinski | 431/10 |

*Primary Examiner*—Carroll B. Dority

*Attorney, Agent, or Firm*—David M. Rosenblum; Larry R. Cassett

[57] ABSTRACT

Fuel is burned in accordance with a burning method and apparatus in two stages and in the presence of first and second oxygen-containing gases, respectively. The second oxygen-containing gas has a higher concentration of oxygen than the first oxygen-containing gas. The fuel stream is burned in a first of the two stages at a first equivalence ratio sufficiently greater than 1.0, so that thermal $NO_x$ formation is inhibited, a more heat transfer effective luminous flame is achieved and a combustible mixture comprising unburned and partially oxidized fuel and fuel radicals is produced for combustion in the second of the two stages. The combustible mixture is burned in the second of the two stages at an equivalence ratio of no greater than about 1.0 so that maximum heat is transferred to the first of the two stages to stabilize combustion therein, and the fuel radicals are sufficiently oxidized by the second oxygen-containing gas to inhibit formation of prompt $NO_x$.

10 Claims, 3 Drawing Sheets

FUEL-BURNER METHOD AND APPARATUS

BACKGROUND OF THE INVENTION

The present invention relates to a fuel-burner method and apparatus in which a stream of fuel is burned in two stages to inhibit $NO_x$ formation. More particularly, the present invention relates to such a a fuel-burning method and apparatus in which combustion of the fuel in a first of the two stages is supported by a first oxygen containing gas and combustion of the fuel is supported in a second of the two stages by a second oxygen-containing gas having a greater oxygen concentration than the first oxygen-containing gas.

Fuel burners are used in furnaces for producing thermal melts for a wide variety of industrial applications. Thermal melts can comprise ferrous and non-ferrous metals, glass, and etc. In order to maximize the power output of a burner, while at the same minimizing fuel consumption, the prior art has provided burners that are designed to oxidize the fuel in the presence of oxygen or oxygen-enriched air. The problem with such furnaces is that atmospheric nitrogen can react with oxygen to produce a noxious pollutant known in the art as thermal $NO_x$. In addition, fuel radicals such as CH can react with atmospheric nitrogen to form prompt $NO_x$. Moreover, in case of liquid fuels, fuel-bound nitrogen may form HCN which can oxidize to form fuel-bound $NO_x$. This problem, which can arise even in those prior art furnaces wherein the oxygen necessary to support combustion is supplied from air, is the result of high combustion temperatures, large availability of fuel radicals and fuel-bound nitrogen in the flame.

In order to alleviate thermal $NO_x$ formation, prior art burners are designed to burn fuel in two stages (staged combustion). In a first stage of combustion, known in the art as the fuel-rich stage, combustion occurs in the presence of substoichiometric amounts of oxygen to lower combustion temperatures and thereby to inhibit thermal $NO_x$ formation. Downstream of the first stage, unburned fuel and combustible hydrocarbons are present. In a second stage of the combustion a combustible mixture of the hydrocarbons and unburned fuel burn in oxygen that is supplied from the same source that is used to support combustion in the first stage. However, in the second stage of combustion, the oxygen is introduced in superstoichiometric amounts to produce what is known in the art as a fuel-lean stage of combustion. The superstoichiometric amounts of oxygen are required to fully oxidize the combustible mixture produced in the first stage of combustion. It is to be noted that the fuel fragments have a lower heat of formation, and as such, thermal $NO_x$ is not a major source of $NO_x$ formation in the second stage of combustion. However, incomplete as well as slow combustion of the combustible mixture in the second stage of combustion can result in high concentrations of hydrocarbon radicals which will react with nitrogen to eventually produce prompt $NO_x$.

Since such prior-art burners utilize the same source of oxygen in both stages, that is air or oxygen or oxygen-enriched air enriched to the same extent in both stages, the difference in the spread between the stoichiometry in the first and second stages of combustion is limited. In this regard, a dimensionless ratio known in the art as equivalence ratio can be obtained by dividing a total amount of fuel by a total amount of oxygen present in any stage of combustion and dividing the result by a quotient of the theoretical amounts of fuel and oxygen that would be necessary to stoichiometrically support combustion. In a fuel-rich stage, the equivalence ratio is greater than 1.0 to indicate the excess of fuel. In the fuel-lean stage, the equivalence ratio is less than 1.0 to indicate the surplus of oxygen.

In the prior art, the maximum equivalence ratio that can be obtained in the fuel-rich stage is limited because a point is reached in which combustion will not be supported given the amount of oxidant being added. In other words, a flame in the fuel-rich stage will eventually not be able to be stabilized and will blow off. In addition, as the fuel-rich stage becomes richer, the fuel-lean stage needs more oxidant to complete combustion. In order to fully oxidize the combustible mixture and prevent prompt $NO_x$ while preventing a blow-off of the second stage flame due to large amounts of oxidant in the second stage, the equivalence ratio of the combustion in the second stage of combustion has to be preferably limited to near stoichiometric proportions. This is difficult to achieve in the case of air or oxygen-enriched air having the same oxygen concentration as in the first stage of combustion because the amount of oxygen-containing gas that is added to the second stage of combustion can act to cool the second stage of combustion and/or blow-off the first stage, thereby extinguishing the flame.

As will be discussed, the present invention provides a two-stage fuel-burning method and apparatus that inherently allows a greater equivalence ratio to be obtained in the first stage of combustion than in the prior art, and also, an equivalence ratio in the second stage of combustion that approaches unity. As a result, $NO_x$ suppression is enhanced over prior art combustion methods and apparatus.

SUMMARY OF THE INVENTION

The present invention provides a method of burning fuel. In accordance with the method, a stream of the fuel is burned in two stages and in the presence of first and second oxygen-containing gases, respectively. The second oxygen-containing gas has a higher concentration of oxygen than the first oxygen-containing gas. The fuel stream is burned in the first of the two stages at a first equivalence ratio sufficiently greater than 1.0 so that thermal $NO_x$ formation is inhibited and a combustible mixture comprising unburned and partially oxidized fuel and fuel fragments and radicals is produced for combustion in a second of the two stages. The combustible mixture is burned in the second of the two stages at an equivalence ratio of about 1.0 so that maximum heat is transferred to the first of the two stages to stabilize the combustion therein and the fuel radicals are oxidized at a sufficiently rapid rate by the second oxygen-containing gas to inhibit formation of prompt $NO_x$.

In another aspect, the present invention provides a fuel-burner for burning a fuel. The fuel-burner is provided with means for forming a stream of the fuel. A first means is provided for introducing a first oxygen-containing gas into the stream of the fuel so that combustion of the fuel and the first oxygen-containing gas occurs in a first of two stages of combustion and at an equivalence ratio of sufficiently greater than 1.0 to inhibit thermal $NO_x$ formation and to produce a combustible mixture comprising unburned and partially oxidized fuel and fuel fragments and radicals. A second means is provided for introducing a second oxygen-containing gas into the stream of the fuel so that combustion of the combustible mixture and the second oxygen-containing gas occurs in a second of the two stages of combustion located downstream of the first of the two stages of combustion. The second means is operable to introduce the second oxygen-containing gas into the stream of the fuel at an equivalence ratio of about 1.0 so that maximum heat is transferred to the first of the two stages of combustion and the fuel radicals are oxidized at a sufficiently rapid rate that prompt $NO_x$ formation is inhibited.

Unlike the prior art, the fuel-burner of the present invention specifically designed to burn two oxygen-containing gases having differing concentrations of oxygen. This feature of the present invention allows the fuel to be burned in the first stage of combustion at a higher equivalence ratio than the prior art and therefore, at a lower temperature, and the combustible mixture to be burned in the second stage of combustion at near stoichiometric conditions to more rapidly oxidize the combustible mixture in lower than prior art amounts of oxygen-containing gas and without going beyond the flamability limits. Since the combustible mixture can be burned in lower than prior art amounts of oxygen-containing gas, heat can be transferred more effectively from the second stage of combustion back to the first stage of combustion to help stabilize combustion at the high equivalence ratios in the first stage that are contemplated by the present invention. The lower first-stage combustion temperatures that are possible in the present invention will produce a greater than prior art inhibition of thermal $NO_x$ formation and the more complete oxidation of the fuel fragments and radicals will produce a greater than prior art inhibition of prompt $NO_x$ formation.

BRIEF DESCRIPTION OF THE DRAWINGS

While the specification concludes with the claims distinctly pointing out the subject matter that Applicant regards as his invention, it is believed that the invention would be better understood when taken in conjunction with the accompanying drawings in which:

DETAILED DESCRIPTION

Figure 1:
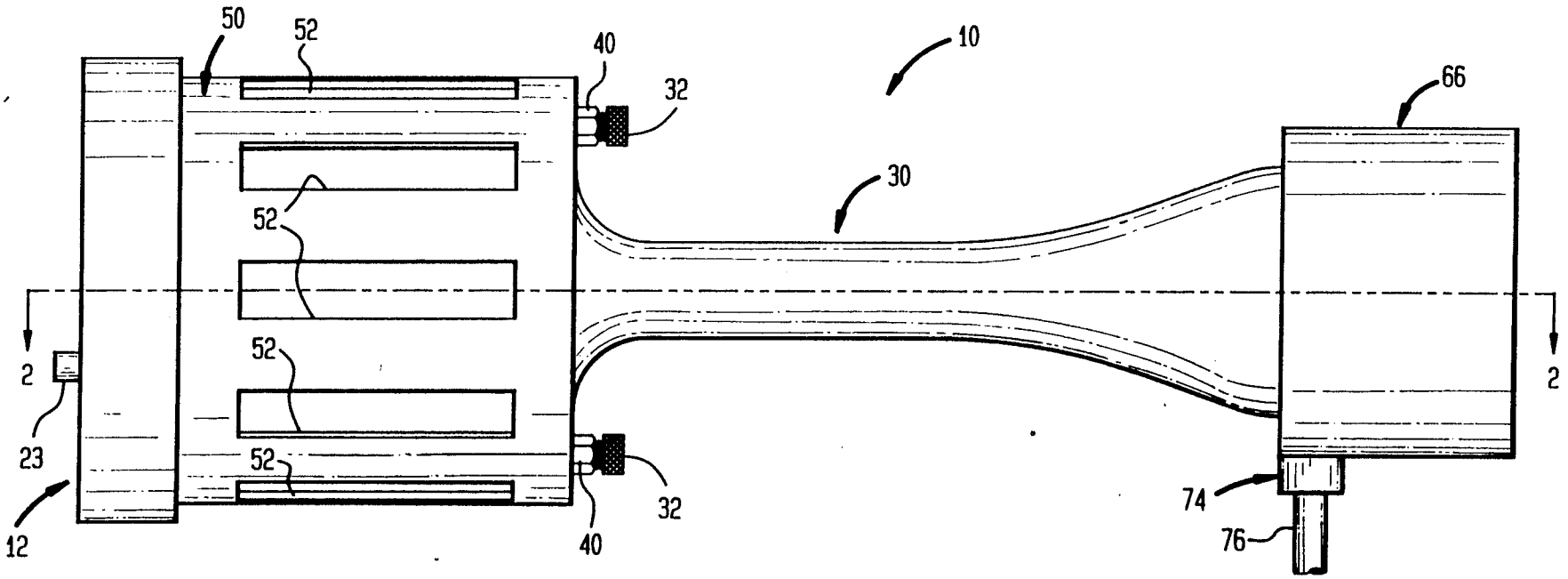
FIG. 1 is a side elevational view of a fuel-burner in accordance with the present invention.
Figure 2:
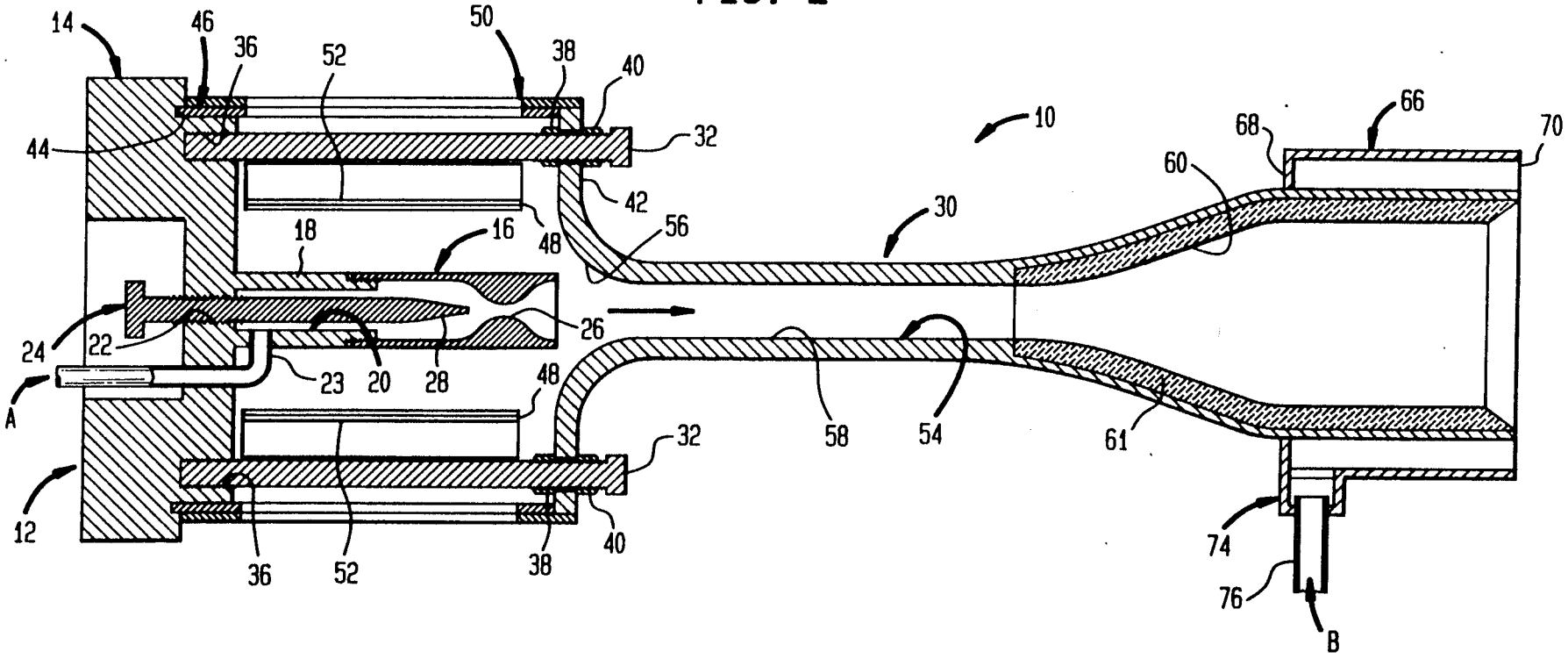
FIG. 2 is a sectional view of FIG. 1 taken along line 2—2 of FIG. 1.

With reference to FIGS. 1 and 2, a fuel-burner 10 in accordance with the present invention is illustrated which can be mounted in a burner block of a furnace in a conventional manner. Fuel burner 10 is specifically designed to burn a gaseous fuel such as methane in two stages. In the first-stage of combustion, the methane is burned in the presence of an oxygen-containing gas, namely, air. In the second stage of combustion, fuel fragments and radicals produced from the first-stage of combustion combustion are burned in the presence of a second oxygen-containing gas, namely, oxygen. This being said, the present invention is by no means limited to methane as a fuel or two stages of combustion supported by air and then oxygen.

The fuel is converted into a stream of the fuel by an injector assembly 12. Injector assembly 12 comprises a base section 14 and a nozzle section 16 of the converging-diverging type. Nozzle section 16 is connected to a projecting portion 18 of base section 14. Base section 14 is provided with a axial bore 20 having a threaded portion 22. Axial bore 20 extends into projecting portion 18 of base section 14 and is further provided with an inlet tube 23 in communication with axial bore 20. The fuel enters inlet tube 23 as indicated by arrowhead A and is discharged from nozzle section 16 as a stream of the fuel after having been accelerated by the converging-diverging configuration of nozzle section 16. A fuel control needle 24 threadably projects into threaded section 22 of axial bore 20 so as to be capable of progressive movement towards and away from a restriction 26 of nozzle section 16. As a tapered end 28 of fuel control needle 24 is positioned closer to restriction 26 of nozzle section 16, the velocity of the stream of the fuel will increase and, vice-versa, independently of volumetric flow rate.

Injector assembly 12 is connected to a burner body 30 by means of four equally spaced threaded studs 32, at one end, threaded into four internally threaded bores 36 provided within base section 14 of injector assembly 12. At the other of the ends of threaded studs 32, studs 32 are connected to burner body 30 by four opposed hex nut sets 38 and 40, tightened against an outwardly flared, flange-like portion 42 of burner body 30.

Base section 14 of injector assembly 12 is provided with a circular groove 44 in which a fixed louvered sleeve 46 is positioned. Fixed louvered sleeve 46 is of cylindrical configuration and is provided with louvers 48. A moveable outer louvered sleeve 50, also of cylindrical configuration and having louvres 52, surrounds inner fixed louvre sleeve 46. The air to support combustion enters louvres 52 and 48 of outer moveable and inner fixed louvered sleeves 50 and 46. Rotation of outer moveable louvered sleeve 50 will either increase or decrease the open area of louvres 52 and 48, and hence the amount of air that will enter a mixture with fuel being formed into a stream of the fuel by injector assembly 12.

Burner body 30 is provided with an axial passageway 54 of circular transverse crossection having a smoothly convergent entrance section 56. A central mixing section 58 of essentially constant diameter and a divergent diffuser section 60 of axial passageway 54 are also provided. The stream of the air first enters entrance section 56 of an axial passageway 54 at a subatmospheric pressure which is induced into the stream of the fuel through its acceleration in nozzle section 16 of injector assembly 12. This produces a subatmospheric pressure in entrance section 56 of axial passageway 54 to aspirate air through louvers 52 and 48 of outer moveable and inner fixed louvered sleeves 58 and 46. Adjusting outer moveable louvre 50 will control the amount of air that will be aspirated. Additionally, adjustment of fuel control needle 24 will also control the amount of air aspirated. As described above, movement of fuel control needle 24 toward restriction 26 will increase the velocity of the fuel. This will cause a further decrease in the pressure and therefore, will cause more air to be aspirated, in effect, leaning out a mixture of fuel and air to be formed. In this manner fuel flow and velocity are independently adjustable. This allows the adjustment of the equivalence ratio in the first-stage independently of the fuel flow-rate. In this regard, fuel and air mixes within central mixing section 58 of axial passageway 54 and the pressure is increased to a super atmospheric pressure by means of diffuser section 60 of axial passageway 54. A conforming ceramic sleeve 61 is set into passageway 54 so as to project into diffuser section 60 thereof and thereby insulate burner body 30.

Figure 3:
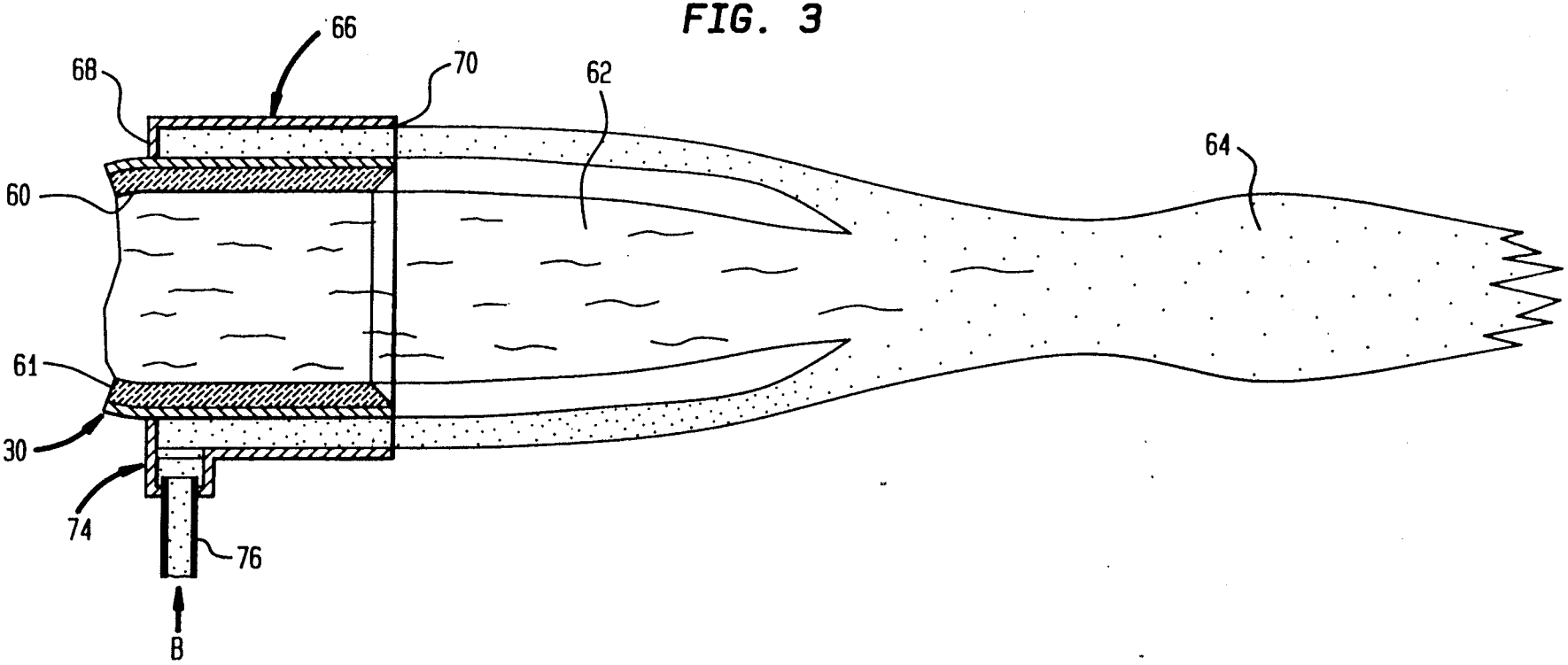
FIG. 3 is a fragmentary view of the fuel-burner of FIG. 1 in operation, illustrating the first and second stages of combustion of fuel produced during its operation.

With reference to FIG. 3, this fuel-rich mixture is combusted or burned in a first-stage of combustion 62. In fact, the equivalence ratio can be at a level that would be beyond the flamability limits of a prior art burner. However, this does not occur in the subject invention due to the injection of oxygen into the stream of the fuel so that the combustible mixture produced from the first-stage of combustion 62 is burned in a second stage of combustion 64 located downstream from and adjacent stage 62. As oxygen is being used, the fuel fragments can be burned in the second of the two stages at an equivalence ratio of about 1.0, that is at near stoichiometry, so that maximum heat is transferred to the first of the two stages to stabilize combustion, and also to sufficiently oxidize the fuel radicals to inhibit formation of prompt $NO_x$. It should be mentioned that burner 10 could introduce oxygen into the second stage of combustion at very low equivalence ratios. However, such a mode of operation would tend to limit the equivalence ratio of combustion in first-stage of combustion 62. At this point, it should be mentioned that the present invention has an inherent advantage over prior art burners that arises from the much higher equivalence ratios that are achievable in the first-stage of combustion. The high equivalence ratios contemplated by a burner of the present invention favor soot formation in the first-stage of combustion. This results in a more luminous and more heat-transfer effective flame.

Injection of oxygen in the present invention is accomplished by a jacket 66 spaced from and surrounding burner body 30 at diffuser section 60 of axial passageway 54. Jacket 66 is closed at one end by an annulus 68 and open at the other end to form an annular opening 70 from which the oxygen is injected. Jacket 66, burner body 30, and ceramic sleeve 55 are shaped so that the front of burner 10 has an inwardly directed, spherical-like curvature. As a result, burner body 30 is recessed from annular opening 70 of jacket 66. This recessing allows the oxygen to be injected downstream of first-stage of combustion 62 into second stage of combustion 64. Oxygen as indicated by arrowhead B enters jacket 66 through an inlet 74 thereof having a pressure fitted inlet pipe 76. As would be well known to those skilled in the art, a mesh or honeycomb-like grating can be provided to prevent first stage of combustion 62 from flashing back in large diameter burner designs using the teachings of the present invention.

Although not illustrated, if a series of apertures were drilled into burner body 30 at diffuser section 60 of axial passageway 54 and level with jacket 66, the stream of the fuel would be burned in the presence of oxygen-enriched air, rather than air alone. Similarly, if apertures were drilled in jacket 66, the second of the combustion stages will also occur in oxygen-enriched air, but having a higher concentration of oxygen.

While the invention has been described with reference to a preferred embodiment, as will be appreciated by those skilled in the art that numerous changes, additions and omissions may be made without departing from the spirit and scope of the invention as set forth in the appended claims.

I claim:

1. A method of burning fuel comprising:

burning a stream of the fuel in two stages and in the presence of first and second oxygen-containing gases, respectively; the second oxygen-containing gas having a higher concentration of oxygen than the first oxygen-containing gas;

the fuel stream being burned in a first of the two stages at a first equivalence ratio of sufficiently greater than about 1.0 so that thermal $NO_x$ formation is inhibited and a combustible mixture comprising unburned and partially oxidized fuel and fuel fragments and radicals is produced for combustion in a second of the two stages; and the combustible mixture being burned in the second of the two stages at an equivalence ratio of about 1.0 so that maximum heat is transferred to the first of the two stages to stabilize the combustion therein and the fuel radicals are oxidized at a sufficiently rapid rate by the second oxygen-containing gas to inhibit formation of prompt $NO_x$.

2. The method of claim 1, wherein the first equivalence ratio is at a sufficiently high level such that combustion would not be supported in the first of the two stages of combustion without the heat transfer thereto from the second of the at least two stages of combustion.

3. The method of claim 1, wherein:

the first oxygen-containing gas is introduced into the stream of the fuel to form a fuel-rich stream having the first equivalence ratio;

the fuel-rich stream is burned in the first of the two stages of combustion;

the second oxygen-containing gas is injected so as to form a mixture with the combustible mixture located downstream of the first of the two stages of combustion so as to form the second stage of combustion directly downstream and adjacent to the first-stage of combustion.

4. The method of claim 2, wherein:

the first of the oxygen-containing gases comprises air; and the air is introduced into the stream of the fuel by, forming the stream of the fuel so that it has a subatmospheric pressure, aspirating the air into the stream of the fuel, mixing the air and the stream of the fuel, forming the fuel-rich stream by diffusing the mixture of the fuel and the stream of air to a superatmospheric pressure.

5. The method of claims 1 or 2 wherein:

the first oxygen-containing gas comprises air; and the second oxygen-containing gas comprises oxygen.

6. The method of claim 4, wherein the second oxygen-containing gas comprises oxygen.

7. A fuel-burner for burning a fuel comprising:

means for forming a stream of the fuel;

first means for introducing a first oxygen-containing gas into the stream of the fuel so that combustion of the fuel and the first oxygen-containing gas occurs in a first of two stages of combustion and at an equivalence ratio of sufficiently greater than 1.0 to inhibit thermal $NO_x$ formation and to produce a combustible mixture comprising unburned and partially oxidized fuel and fuel fragments and radicals; and second means for introducing a second oxygen-containing gas, having a higher oxygen concentration than the first oxygen-containing gas, into the stream of the fuel so that combustion of the combustible mixture and the second oxygen-containing gas occurs in a second of the two stages of combustion located downstream from the first of the two stages of combustion;

the second means operable to introduce the second oxygen-containing gas into the stream of the fuel at an equivalence ratio of about 1.0 so that maximum heat is transferred from the second of the two stages of combustion to the first of the two stages of combustion and the fuel radicals are oxidized at a sufficiently rapid rate that prompt $NO_x$ formation is inhibited.

8. The burner of claim 7, wherein:

the first oxygen-containing gas comprises air;

the fuel stream forming means form the stream of the fuel so that it has a subatmospheric pressure; and the first means comprises an elongated burner body having an axial passageway operatively associated with the fuel stream forming means so that the stream of the fuel is directed through the axial passageway;

the axial passageway including, an entrance section, smoothly convergent and positioned to define with the fuel stream forming means an annular area through which the air is aspirated;

a mixing section located downstream of the entrance section configured to mix the fuel and air together; and a diffuser section configured to impart an increased, superatmospheric pressure to the fuel and air mixture before being discharged from the passageway.

9. The burner of claim 8, wherein the second means comprises a jacket surrounding the burner body and open at one end thereof to form an annular nozzle surrounding the burner body for injecting the second oxygen-containing gas.

10. The burner of claims 8 or 9, wherein the fuel stream forming means comprises:

an injector body having a convergent, divergent passageway;

a tapered pin projecting into the convergent, divergent passageway and movable in an axial direction to increase and decrease the velocity of the fuel stream depending upon the axial direction of movement thereof; and means for supporting and for selectively moving the tapered pin in the axial direction.

* * * * *